US007731438B2

(12) United States Patent
Sakano

(10) Patent No.: US 7,731,438 B2
(45) Date of Patent: Jun. 8, 2010

(54) SHEET BUNDLE PRINTER AND SHEET BUNDLE PRINTING SYSTEM

(75) Inventor: Hideki Sakano, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 511 days.

(21) Appl. No.: 11/842,794

(22) Filed: Aug. 21, 2007

(65) Prior Publication Data

US 2008/0056796 A1 Mar. 6, 2008

(30) Foreign Application Priority Data

Aug. 29, 2006 (JP) ..... 2006-232744

(51) Int. Cl.
*B41J 13/02* (2006.01)
*B41J 13/03* (2006.01)
*B41J 33/54* (2006.01)

(52) U.S. Cl. ..... 400/649; 400/624; 400/628; 400/629

(58) Field of Classification Search ..... 400/649, 400/660.2, 624, 625, 628, 629; 221/43; 347/218, 347/220

See application file for complete search history.

(56) References Cited

U.S. PATENT DOCUMENTS 4,746,234 A * 5/1988 Harry ..... 400/120.01
2002/0012039 A1* 1/2002 Kimura et al. ..... 347/218
2004/0061768 A1* 4/2004 Nishimura ..... 347/218
2005/0271448 A1* 12/2005 Shmaiser et al. ..... 400/624
2007/0183831 A1* 8/2007 Nakajima ..... 400/629
2008/0022873 A1* 1/2008 Sakano ..... 101/273
2008/0053324 A1* 3/2008 Kurashina ..... 101/244

FOREIGN PATENT DOCUMENTS

EP 315384 A2 * 5/1989
JP 04101852 A * 4/1992
JP 04353469 A * 12/1992
JP 2003-011436 1/2003
JP 2003-011437 1/2003
JP 2003-212367 7/2003
JP 2006-175878 7/2006

* cited by examiner

*Primary Examiner*—Daniel J Colilla
(74) *Attorney, Agent, or Firm*—Hogan & Hartson LLP

(57) ABSTRACT

A sheet bundle printer peeling off and performing printing on an uppermost sheet of a peelably adhered sheet bundle includes a print head performing printing on the sheet, a platen roller, at a print position, cooperating with the print head to feed both the sheet and an ink ribbon, pinched therebetween, and a platen moving mechanism moving the platen roller between the print position and a non-print position. The platen moving mechanism includes a manual operation device manually moving the platen roller from the print to non-print positions and a press roller that made to contact or moved away from the platen roller by the manual operation device to move the platen roller from the print to non-print positions while pressing it when the press roller contacts it. At the non-print position, the sheet is allowed to pass between the press roller and the platen roller.

12 Claims, 9 Drawing Sheets

SHEET BUNDLE PRINTER AND SHEET BUNDLE PRINTING SYSTEM

The entire disclosure of Japanese Patent Application No. 2006-232744, filed Aug. 29, 2006, is expressly incorporated by reference herein.

BACKGROUND

1. Technical Field

The present invention relates to a sheet bundle printing system for printing on a piece of sheet (hereinafter simply referred to as "a sheet") to be peeled off out of a sheet bundle such as a sticky note bundle (i.e., a bundle of sticky notes temporarily held together by partially and removably adhering them together for use by peeling off one by one) and the like, and also relates to a sheet bundle printer.

2. Related Art

In the known art, there is a sticky note printer (a sheet bundle printer) of this type, which pulls up an uppermost sticky note of a sticky note bundle that is set in the printer, pinches the pulled-up sticky note together with an ink ribbon between a thermal head and a platen roller, and then performs printing on the sticky note while feeding the sheet so as to peel it off, which is, for example, described in Japanese Unexamined Patent Application Publication No. 2003-212367.

Meanwhile, a blank sticky note may possibly be used, for example, when people use the sticky note to write a note or when people use it to mark magazines, or the like. Then, the sticky note printer needs to eject a blank sticky note (white sticky note) without performing printing on the sheet. However, in the above known sticky note printer, when a sticky note is fed without performing printing on it (when a blank sticky note is fed), it is conceivable that the platen roller and the thermal head pinch and feed the sticky note while the thermal head is not being driven (or is being driven with no printing data). In this case, it is preferable that the feeding of the ink ribbon is stopped in order to suppress a waste of ink ribbon. However, when the printer is operated in such a way, because the sticky note is fed as it slides on the ink ribbon, there is a problem that ink of the ink ribbon is rubbed to smudge the sticky note or the ink ribbon is also fed with the feeding of the sticky note (jamming of ink ribbon).

SUMMARY

An advantage of some aspects of the invention is that it provides a sheet bundle printer and sheet bundle printing system that are capable of suppressing a waste of ink ribbon while it smoothly feeds a blank sheet of sheet toward a sheet ejecting slot.

A first aspect of the invention provides a sheet bundle printer that peels off an uppermost sheet out of a sheet bundle that is formed by stacking a multiplicity of sheets releasably adhered together at one end respectively, each having one end that is peelably adhered to that of another sheet, and that performs printing on the sheet while transporting the sheet toward a sheet ejecting slot. The sheet bundle printer includes a print head, a platen roller, and a platen moving mechanism. The print head performs printing on the sheet. The platen roller, when located at a print position where the platen roller contacts the print head, cooperates with the print head to feed both the sheet and an ink ribbon, which are pinched between the print head and the platen roller. The platen moving mechanism moves the platen roller between the print position and a non-print position where the sheet is passed toward the sheet ejecting slot in a state where the sheet is located away from the print head. The platen moving mechanism includes a manual operation device and a press roller. The manual operation device is used for manually moving the platen roller from the print position to the non-print position. The press roller is made to contact or moved away from the platen roller by means of the manual operation device and moves the platen roller from the print position to the non-print position while pressing the platen roller in a state where the press roller is in contact with the platen roller. At the non-print position, the sheet is allowed to pass between the press roller and the platen roller.

A second aspect of the invention provides a sheet bundle printer that peels off an uppermost sheet out of a sheet bundle that is formed by stacking a multiplicity of sheets, each having one end that is peelably adhered to that of another sheet, and that performs printing on the sheet while transporting the sheet toward a sheet ejecting slot. The sheet bundle printer includes a print head, a platen roller, and a platen moving mechanism. The print head performs printing on the sheet. The platen roller, when located at a print position where the platen roller contacts the print head, cooperates with the print head to feed both the sheet and an ink ribbon, which are pinched between the print head and the platen roller. The platen moving mechanism moves the platen roller between the print position and a non-print position where the sheet is passed toward the sheet ejecting slot in a state where the sheet is located away from the print head. The platen moving mechanism includes a roller moving device and a press roller. The roller moving device is used for moving the platen roller from the print position to the non-print position. The press roller is made to contact or moved away from the platen roller by means of the roller moving device and moves the platen roller from the print position to the non-print position while pressing the platen roller in a state where the press roller is in contact with the platen roller. At the non-print position, the sheet is allowed to pass between the press roller and the platen roller.

According to the above structure, it is possible to move the platen roller to the non-print position using the manual operation device or the roller moving device through the press roller. Thus, when a blank sheet is fed, the platen roller is moved to the non-print position in advance to make a space between the print head and the platen roller, so that the print head and the platen roller do not pinch the sheet and the ink ribbon together. In this manner, the sheet, while being fed, does not slide on the ink ribbon, so that ink of the ink ribbon is not rubbed to smudge the sheet and the ink ribbon is not fed with the feeding of the sheet. Meanwhile, as the platen roller is moved to the non-print position, the platen roller contacts the press roller. Then, because the sheet is fed while it is being pinched between the platen roller and the press roller, it is possible to appropriately transport the sheet toward the sheet ejecting slot. Note that, in this case, it is preferable that the press roller that has moved the platen roller to the non-print position cooperates with the platen roller to transport the sheet. In addition, a sticky note bundle, a memo pad, or the like, may be employed as the sheet bundle.

In the above first aspect, the manual operation device may include a manual operation lever that is manipulated for moving the press roller and a moving rod that moves the press roller by manipulating the manual operation lever.

According to this structure, by manipulating the manual operation lever, it is possible to arbitrarily move the platen roller through the press roller to the print position and to the non-print position.

In this case, the sheet bundle printer may further include a reset device and a locking/unlocking device. The reset device resets the platen roller, that has moved to the non-print position, to the print position in response to releasing of the press roller pressing the platen roller. The locking/unlocking device includes a locking device and a lock releasing device. The locking device holds a state where the platen roller is moved to the non-print position by manipulating the manual operation lever through the press roller. The lock releasing device, after transporting of the sheet by the press roller and the platen roller is completed, moves the platen roller, using the reset device, to the print position.

According to this structure, by manipulating the manual operation lever, the platen roller is locked at the non-print position by the locking/unlocking device, so that it is unnecessary for a user to continue manipulating the manual operation lever during transporting of the sheet. On the other hand, as the transporting of the sheet is completed, the locking is released in response to this completion. The platen roller is then moved to the print position by the reset device, so that it is unnecessary for a user to return the platen roller by manipulating the manual operation lever. In this manner, it is possible to improve operability of the manual operation lever.

In the above second aspect, the roller moving device may include a solenoid that is used for moving the press roller and a moving rod that moves the press roller by driving of the solenoid.

According to this structure, by energizing or de-energizing the solenoid, it is possible to move the press roller with a simple structure.

In this case, the roller moving device may include an actuator that is used for moving the press roller, a plate cam that is made to rotate by driving of the actuator, and a moving rod that moves the press roller on the basis of a state where the plate cam contacts the moving rod.

According to this structure, by rotating the plate cam with the actuator, it is possible to move the press roller with a low-cost structure.

In the above aspects, the sheet bundle printer may include a detection device and a control device. The detection device detects whether the platen roller is moved to the non-print position by the press roller. The control device controls the print head, the platen roller and the platen moving mechanism. The control device controls feeding of the sheet toward the sheet ejecting slot on the basis of a result detected by the detection device.

According to this structure, by using a detection by the detection device as a trigger, it is possible to initiate to feed a blank sheet. For this reason, as far as the platen roller is not moved to the non-print position, the blank sheet is not fed.

In this case, the sheet bundle printer may further include a reset device that resets the platen roller, that has moved to the non-print position, to the print position by releasing the press roller pressing the platen roller and a bearing portion that pivotally supports the platen roller so as to slide between the print position and the non-print position. The reset device has an urging member that is in contact with a rotary shaft portion of the platen roller and that urges the platen roller toward the print position while the platen roller is being guided by the bearing portion.

According to this structure, it is possible to move the platen roller to the non-print position against an urging force of the urging member by pressing the platen roller with the press roller. On the other hand, when the pressing of the press roller is released, it is possible to move the platen roller to the print position by the urging force of the urging member. In this manner, it is possible to move the platen roller that has moved to the non-print position, to the print position with a simple structure.

In this case, the platen roller may double as a roller for pulling up and peeling off the sheet, and the sheet bundle printer may further include a roller arm, a folded mechanism, and a return spring. The roller arm holds the platen roller at its distal end and allows the platen roller to reciprocally move between a pull up position where the sheet is pulled up and the print position, having the non-print position located in a path of the reciprocal movement. The folded mechanism is provided in the roller arm and holds the roller arm to be foldable only when the platen roller is moved from the pull up position toward the print position. The return spring returns the roller arm, when being folded, to an original attitude. The return spring doubles as the reset device.

According to this structure, as the press roller is moved in order to restrict the position of the platen roller at the non-print position and the platen roller is moved toward the print position by the roller arm, the roller arm is folded by means of the folded mechanism in a state where the position of the platen roller is restricted by the press roller at the non-print position. On the other hand, as the platen roller is moved to the pull up position by the roller arm, the roller arm is returned from the folded attitude to the original attitude by the return spring. That is, when the pressing of the platen roller by the press roller is released, it is possible for the roller arm to appropriately move the platen roller to the print position. For this reason, without any change in reciprocal movement of the roller arm, it is possible to restrict the position of the platen roller at the non-print position owing to the folded mechanism, and it is also possible to appropriately move the platen roller to the print position by the roller arm by returning the folded attitude of the roller arm to the original attitude by the return spring.

In this case, the platen roller may double as a roller for pulling up and peeling off the sheet, and the sheet bundle printer may further include a roller arm, a shaft portion, a pivotal device, and a torque limiter. The roller arm holds the platen roller at its distal end. The shaft portion is provided at the proximal end of the roller arm and supports the roller arm. The pivotal device pivots the roller arm through the shaft portion so as to move the platen roller between a pull up position where the sheet is pulled up and the print position, having the non-print position located in a path of the reciprocal movement. The torque limiter is provided between the shaft portion and the pivotal device. The pivotal device doubles as the reset device.

According to this structure, the press roller is moved in order to restrict the position of the platen roller at the non-print position, and the platen roller is moved toward the print position by the roller arm. Then, at the time when the position of the platen roller is restricted at the non-print position by the press roller, the pivotal movement of the roller arm is slipped by the torque limiter, so that it is possible to maintain a state where the position of the platen roller is maintained at the non-print position. On the other hand, when the pressing of the platen roller by the press roller is released, it is possible for the roller arm to appropriately move the platen roller to the print position.

In this case, the sheet bundle printer may further includes a ribbon feed device and a ribbon feed stopping device. The ribbon feed device feeds the ink ribbon side by side with the sheet when the sheet is printed. The ribbon feed stopping device stops the ribbon feed device feeding the ink ribbon in response to movement of the platen roller to the non-print position by the platen moving mechanism.

According to this structure, as the platen roller is moved to the non-print position by the platen moving mechanism, the ribbon feed stopping device stops feeding of the ink ribbon. In this state, when the sheet is transported, the sheet passes through a space between the print head and the platen roller and is fed toward the sheet ejecting slot; however, the ink ribbon is not fed together. In this manner, it is possible to feed a blank sheet without a waste of ink ribbon.

A third aspect of the invention provides a sheet bundle printing system. The sheet bundle printing system includes the above described sheet bundle printer and a computer that is connected to the sheet bundle printer and that controls the sheet bundle printer. The sheet bundle printer includes a detection device that detects whether the platen roller is moved to the non-print position by the press roller. The computer includes a control device that controls the print head, the platen roller and the platen moving mechanism. The control device controls feeding of the sheet toward the sheet ejecting slot without performing printing on the sheet on the basis of a result detected by the detection device.

According to this structure, the sheet bundle printer is controlled using the computer and it is possible to feed the sheet in a state where the platen roller is located a distance away from the print head when a blank sheet is fed, so that it is possible to smoothly feed a blank sheet.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a first embodiment of a sticky note printing system in which a sheet bundle printer according to the invention is installed will be described with reference to the accompanying drawings. The sticky note printing system, on the basis of print data edited with a personal computer, using a sticky note printer, pulls up an uppermost sticky note from a sticky note bundle (a sheet bundle) that is set in the sticky note printer and performs printing while peeling off the sticky note that has been pulled up, and then ejects the printed sticky note to outside the system.

Figure 1:
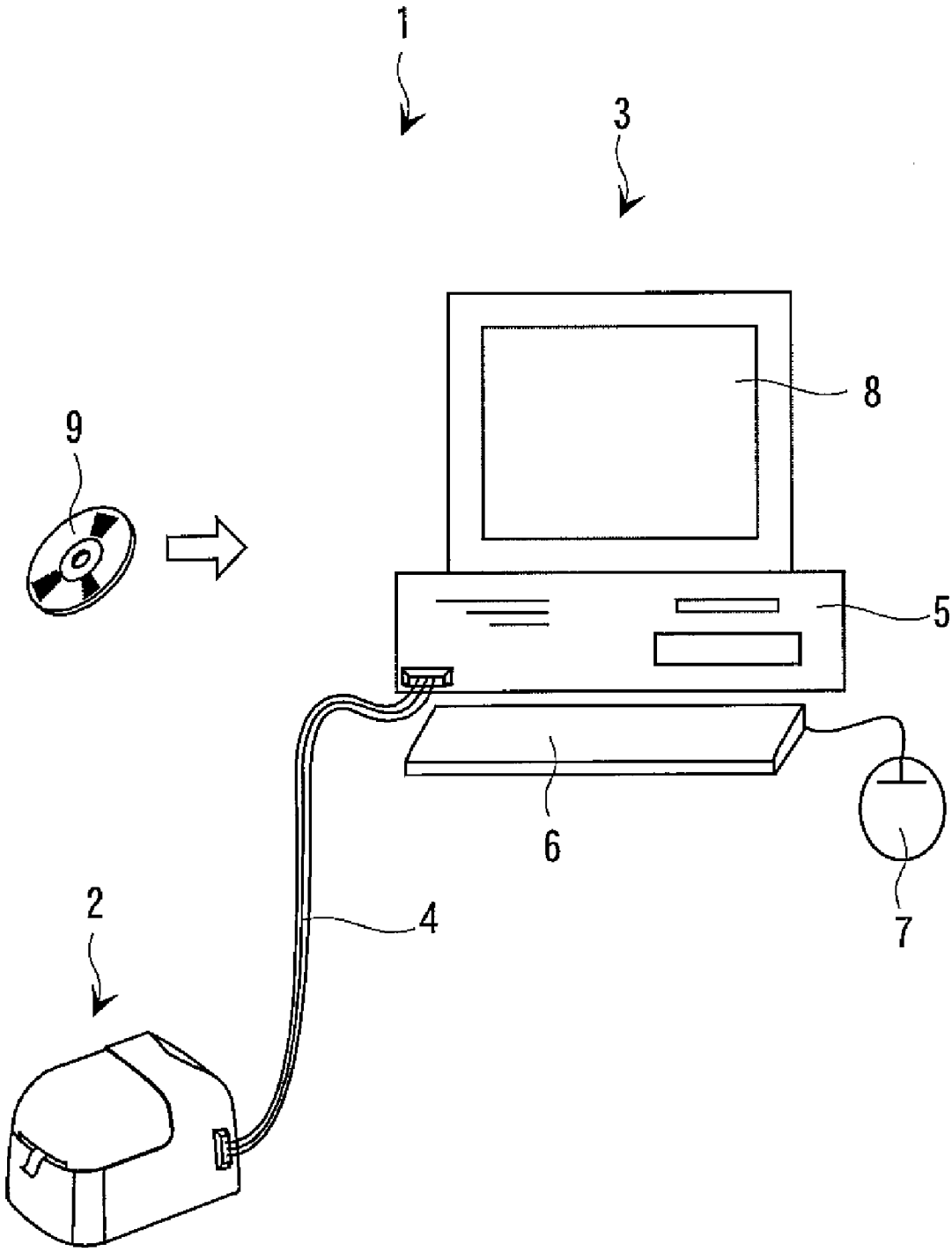
FIG. 1 is a schematic view of a sticky note printing system according to a first embodiment of the invention.

As shown in FIG. 1, the sticky note printing system 1 includes a sticky note printer 2 and a personal computer (controller) 3. A sticky note bundle H is set in the sticky note printer 2. The personal computer 3 is connected to the sticky note printer 2 through a USB cable 4, or the like. The personal computer 3 creates and/or edits print data to be printed on a sticky note H1 and controls driving of various portions of the sticky note printer 2.

The personal computer 3 includes a personal computer body 5, a keyboard 6, a mouse 7, and a display 8, which are connected to the personal computer body 5. The keyboard 6 and the mouse 7 are used for inputting data. The display 8 displays input results, or the like. The personal computer body 5 has set application software (program) relating to the sticky note printer 2 and also has detachably set a CD-ROM 9 in which data, such as a device driver, are stored. When various detection signals, various commands, various data, or the like, are input using the keyboard 6, or the like, the personal computer 3, in accordance with a program stored in the CD-ROM 9, processes such various data and then controls the sticky note printer 2.

Needless to say, it is also applicable that the stand-alone sticky note printer 2, which is provided with a function of creating and/or editing print data and a function of controlling the portions of the printer, performs printing on the sticky note H1.

Figure 2:
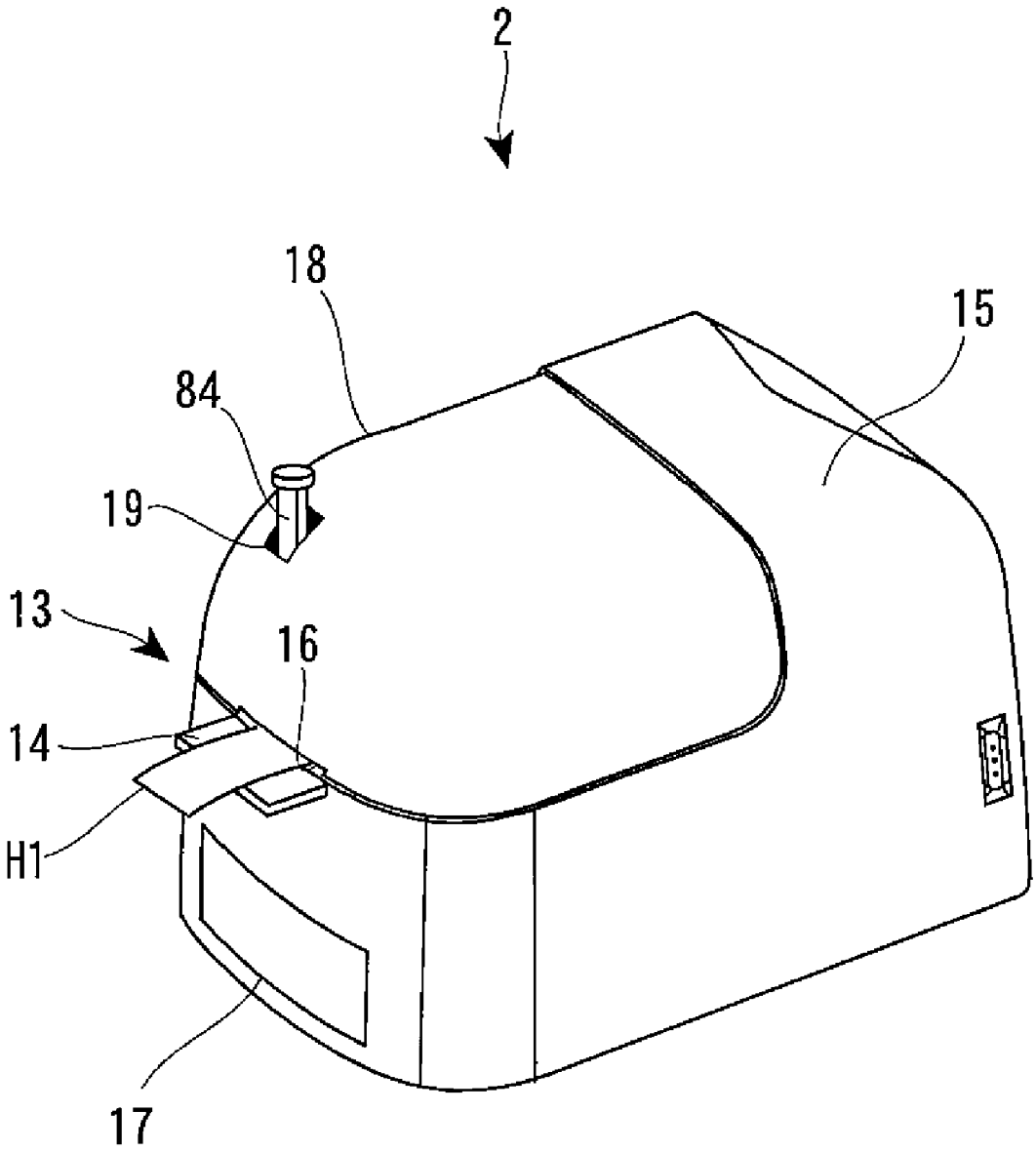
FIG. 2 is a perspective view of a sticky note printer according to the first embodiment of the invention.

As shown in FIG. 2, the sticky note printer 2 has a printer case 15, forming an outer case, and a sticky note bundle H is set inside the printer case 15. The sticky note printer 2 prints desired lines of characters, created with the personal computer 3, onto the sticky note H1 that has peeled off from the set sticky note bundle H and then ejects the printed sticky note H1 through a sheet ejecting portion 13 formed in the printer case 15.

The size of the printer case 15 is small as a whole. A sticky note setting opening 17 is formed in the front lower portion of the printer case 15 and is used for setting a pullout sticky note holder 20, which will be described later, into the case from the front. The sheet ejecting portion 13 is provided in the front middle portion of the printer and has a horizontal slit-like sheet ejecting slot 16 that ejects a printed sticky note H1 to outside the case and a receiving portion 14 that extends from the inside of the case via the sheet ejecting slot 16 to the outside of the case and that receives the peeled-off and printed sticky note H1. In addition, a ribbon cartridge C that contains an ink ribbon R is installed on the upper surface of the printer case 15 and an openable cover 18 is provided on the upper surface of the printer case 15 for allowing maintenance. Further, an operation opening 19, through which a manual operation lever 84, which will be described later, projects, is formed in the left upper portion of the openable cover 18. The operation opening 19 allows the manual operation lever to move upward and downward.

Figure 3:
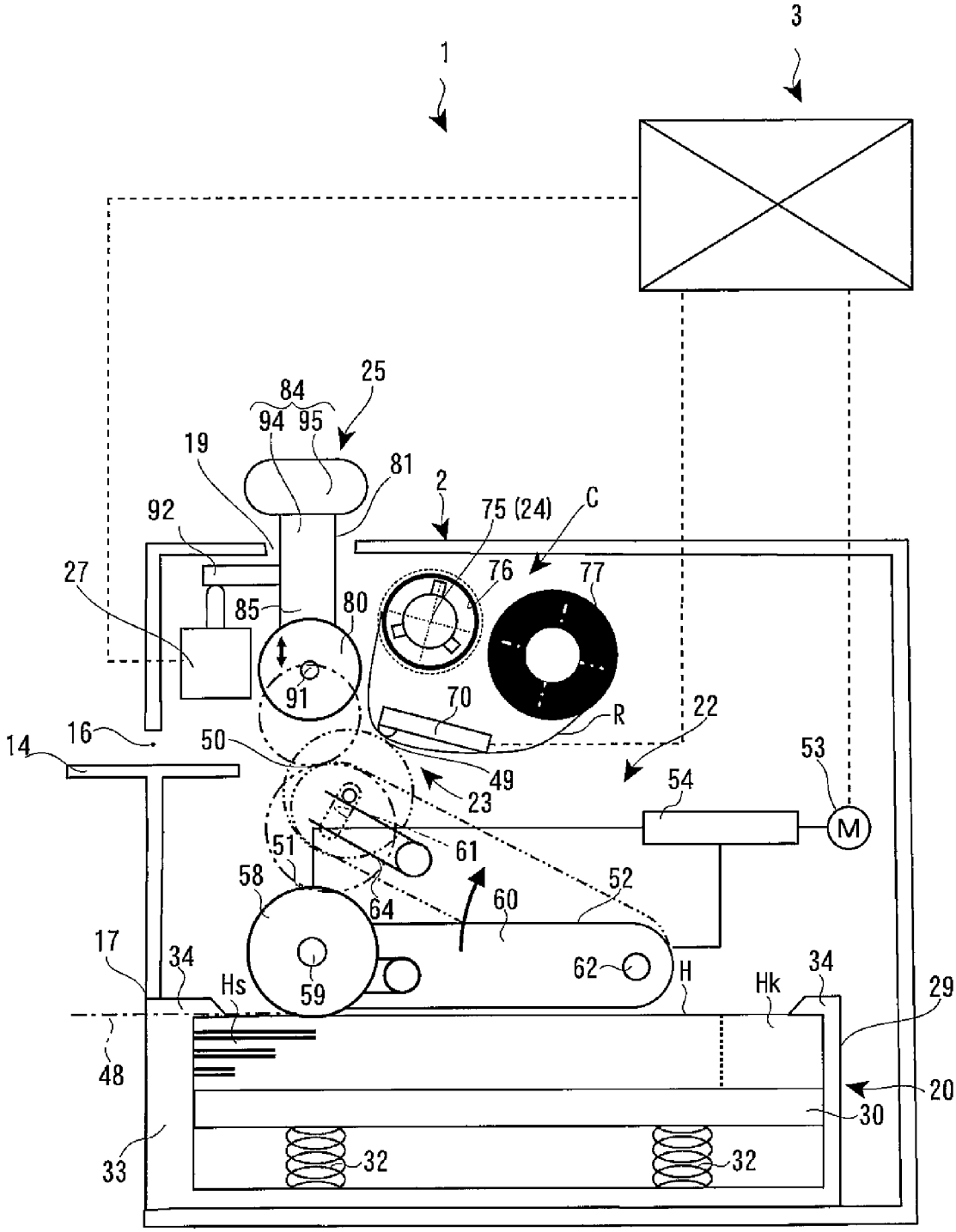
FIG. 3 is a schematic internal view of the sticky note printer according to the first embodiment of the invention.

As shown in FIG. 3, the sticky note bundle H is formed of a plurality of sticky notes H1 whose proximal ends Hk of the back faces are partially adhered to that of another sheet. In other words, the sticky note bundle H is formed so that a plurality of sticky notes H1, each having the same shape (rectangular shape) and the same size, are stacked by partially adhering the proximal ends Hk of the back faces of the sticky notes H1 to one another. The sticky notes H1 can be each peeled off sheet by sheet by peeling off its adhesive free end from the sticky note bundle H and, after the peeling, is restickable on a handbook, or the like, by means of the adhesive portion (with adhesive agent) of the proximal portion Hk.

The sticky note printer 2 includes the sticky note holder 20, a sticky note transport unit 22, a thermal head (print head) 70, and a platen roller 51. The sticky note bundle H is set in the sticky note holder 20. The sticky note transport unit 22, after pulling up an uppermost sticky note H1 of the set sticky note bundle H, peels off the sticky note H1 and transports the note H1 toward the sheet ejecting slot 16. The sticky note printer 2 further includes a printing unit 23, a ribbon feeding unit 24, a platen moving mechanism 25, and a ribbon feed stopping unit 26. The printing unit 23 performs printing on a sticky note H1 that is transported by the sticky note transport unit 22. The ribbon feeding unit 24 feeds an ink ribbon R used for printing. The platen moving mechanism 25 allows the platen roller 51 to approach and move away from the thermal head 70. The ribbon feed stopping unit 26 stops feeding the ink ribbon R at the same time when the platen roller 51 is moved. These components are contained in the above printer case 15. In addition, the sticky note printer 2 yet further includes a detection sensor (a detection unit) 27 and a locking/unlocking unit 28 (see FIG. 5). The detection sensor 27 detects whether the platen roller 51 is moved away from the thermal head 70. The locking/unlocking unit 28 holds a state where the platen roller 51 is located a distance from the thermal head 70 by the platen moving mechanism 25 and also releases this holding state. Although the details will be described later, the platen roller 51 doubles as a feeding roller of the sticky note transport unit 22.

The sticky note holder 20 includes a sticky note bundle case 29 and a mounting stage 30. The sticky note bundle case 29 is formed in a box shape with its top opened. The mounting stage 30 is contained in the sticky note bundle case 29 and mounts the sticky note bundle H horizontally. Four coil springs (two of them shown in the drawing) 32 are interposed between the mounting stage 30 and the bottom surface of the sticky note bundle case 29 and urge the mounting stage 30 upward. In addition, the sticky note holder 20 is provided so that it may be pulled out from the printer case 15 and is detachably mounted through the sticky note setting opening 17. Thus, when the sticky note bundle H is charged or replaced, the whole sticky note holder 20 is removed and the sticky note bundle H is then set.

The sticky note bundle case 29 includes a box-shaped case body 33 and a pair of position regulating portions 34, which are integrally formed with each other. The case body 33 slidably guides the mounting stage 30. The pair of position regulating portions 34 are provided at both upper ends of the case body 33 and project inward so as to hold the free end Hs and proximal end Hk of the sticky note bundle H.

The mounting stage 30 is formed in a plate-like shape and is urged upward by the four coil springs 32. When the sticky note bundle H is set on the mounting stage 30, the pair of position regulating portions 34 maintain the level of the uppermost sticky note H1 at a constant height even when the sticky notes H1 are fed sheet by sheet and reduced in number. Then, the position where the sticky note bundle H is set corresponds to a pull up position 48 where the sticky note transport unit 22 pulls up a sticky note H1.

When the sticky note bundle H is set onto the mounting stage 30 of the sticky note holder 20 through the upper opening of the sticky note bundle case 29, the sticky note bundle H is urged upward by the coil springs 32 and the distal end Hs and proximal end Hk of the sticky note bundle H are positioned at the pull up position 48 so that the pair of position regulating portions 34 maintain the sticky note bundle H being mounted horizontally.

The sticky note transport unit 22 is configured to pull up the uppermost sticky note H1 of the sticky note bundle H, located at the pull up position 48. The sticky note transport unit 22 includes the platen roller 51, a pair of roller arms 52, a drive motor 53, and a reduction gear train (power transmitting gear train) 54. The platen roller 51 rolls on and contacts the uppermost sticky note H1, pulls up the sticky note H1 and then peels off the pulled-up sticky note H1. The roller arms 52 move (rotate) the platen roller 51 in a range between the pull up position 48 and a print position 49 where the sticky note H1 is pinched with the thermal head 70. The drive motor 53 is a drive source (power source) of the platen roller 51 and the pair of roller arms 52. The reduction gear train 54 transmits the driving force of the drive motor 53 to the platen roller 51 and the pair of roller arms 52.

The platen roller 51 rolls on and contacts the back surface of the free end of pulled-up sticky note H1 and rotates to feed the sticky note H1 while peeling it off. The platen roller 51 includes a roller body 58 and a roller drive shaft (rotary shaft portion) 59. The roller body 58 directly rolls on and contacts the sticky note H1. The roller drive shaft (rotary shaft portion) 59 serves as a rotary shaft of the roller body 58. Both ends of the roller drive shaft 59 are rotatably held by the pair of roller arms 52. The roller drive shaft 59 rotates with the power of the drive motor 53 transmitted through the reduction gear train 54 (which will be described later).

Each of the roller arms 52 includes an arm body 60, a bearing portion 61 and a pivotal shaft portion (shaft portion) 62. The bearing portion 61 is provided at the distal end of each arm body 60 and is formed in an oblong shape so as to movably and pivotally support the platen roller 51 that is moved by the platen moving mechanism 25. The pivotal shaft portion 62 is provided at the proximal end of each roller arm 52 for inputting power of the drive motor 53 through the reduction gear train 54. For this reason, the pair of roller arms 52 are configured to pivot (swing) the platen roller 51 reciprocally about the pivotal shaft portion 62, provided at the distal end thereof, between the pull up position 48 and the print position 49. In addition, a releasing boss 63 (see FIG. 5) is formed on the side face of one of the pair of roller arms 52. The releasing boss 63 contacts a contact piece 115, which will be described later. This releasing boss 63 allows the locking/unlocking unit 28 to release a locking state (the details of which will be described later).

Each of the bearing portions 61 has an oblong hole formed to extend along a circumferential direction about the pivotal shaft portion 62 when the movement of the platen roller 51 is restricted by the platen moving mechanism 25, which will be described later, the roller drive shaft 59 slides relatively along the pair of bearing portions 61, thus allowing the pivotal movement of the pair of roller arms 52. Hence, without any change in pivotal movement of the pair of roller arms 52, it is possible for the platen moving mechanism 25 to restrict the movement of the platen roller 51. Although the details will be described later, an urging spring (urging member) 64 is provided near the bearing portion 61 of each arm body 60 so as to contact the roller drive shaft 59 and urge the platen roller 51 toward the print position 49. This urging springs 64 serve as reset units of the platen moving mechanism 25.

The printing unit 23 includes the thermal head 70 and the platen roller 51. The thermal head 70 performs printing on the sticky note H1 that is fed by the sticky note transport unit 22. The platen roller 51 is located at the print position 49 and is opposite the thermal head 70. The platen roller 51 is configured to rotate while moving toward the print position 49. The platen roller 51 performs printing by means of the thermal head 70 while feeding the peeled-off sticky note H1. Further, the platen roller 51 is moved by the platen moving mechanism 25, which will be described later, between the print position 49 where printing is performed by pinching the sticky note H1 and the ink ribbon R together with the thermal head 70 and a non-print position where the platen roller 51 is located a distance away from the thermal head 70 to enter a released state. The thus configured printing unit 23 performs a print and feed operation on the sticky note H1 while the thermal head 70 and the drive motor 53 are being controlled on the basis of control signals sent from the personal computer 3.

The ribbon feeding unit 24 includes the ribbon cartridge C and a ribbon take up shaft 75. The ribbon take up shaft 75 winds the ink ribbon R of the set ribbon cartridge C. The ribbon take up shaft 75 is configured so that, as the platen roller 51 is moved to the print position 49, the ribbon take up shaft 75 is coupled to the reduction gear train 54 and is rotated by the power input from the drive motor 53. The ribbon cartridge C includes a ribbon pay out reel 76, a ribbon take up reel 77, and a cartridge case (not shown). The ribbon pay out reel 76 winds the ink ribbon R so that the ink ribbon R may be paid out. The ribbon take up reel 77 takes up the ink ribbon R. The cartridge case contains these components so as to be rotatable.

When the ribbon cartridge C is set by opening the openable cover 18, the ink ribbon R is located between the thermal head 70 and the platen roller 51, and the ribbon take up reel 77 is pivotally supported by the ribbon take up shaft 75. Then, as the printing operation is initiated by the personal computer 3, the ribbon take up shaft 75 is configured to start taking up (feeding) the ink ribbon R, following the feeding of the sticky note HI.

The platen moving mechanism 25 includes a press roller 80, a manual operation unit 81, and an urging member 64. The press roller 80 is located adjacent to the sheet ejecting slot 16. The press roller 80 slides and contacts on the platen roller 51 and restricts the platen roller 51 being positioned at a non-print position 50. The manual operation unit 81 manually makes the press roller 80 contact the platen roller 51 or moves it away therefrom. The urging spring (reset unit) 64 returns the platen roller 51, whose position has been restricted at the non-print position 50, to an original state. That is, the movement in which the platen roller 51 is made to contact or move away from the thermal head 70 is performed by the manual operation unit 81 through the press roller 80.

The press roller 80 is a rotary roller which is arranged downstream of the thermal head 70 in the direction in which the sticky note is fed. Note that, when the sticky note H1 is being fed while printing, that is, when the press roller 80 is located a distance away from the platen roller 51, the press roller 80 may serve as a guide for the sticky note H1 that is fed toward the sheet ejecting slot 16 by the platen roller 51 and the thermal head 70. Although the details will be described later, the press roller 80, when the blank sticky note H1 is fed, serves as a driven roller relative to the platen roller 51, which is a drive roller.

The manual operation unit 81 is configured to place the press roller 80 in the path of movement of the platen roller 51 that reciprocally moves between the pull up position 48 and the print position 49. The manual operation unit 81 includes a manual operation lever 84 and a moving rod 85. The press roller 80 is operatively moved with the manual operation lever 84. The moving rod 85 supports the press roller 80 and also moves the press roller 80 with the operation of the manual operation lever 84. Therefore, as the press roller 80 is located in the path along which the platen roller 51 moves and the platen roller 51 is moved from the pull up position 48 to the print position 49, the movement of the platen roller 51 is restricted and positioned at the non-print position 50.

The moving rod 85 is configured, by means of operation of the manual operation lever 84, to reciprocally move the press roller 80 between a pressing position 87 where the press roller 80 is located in the path along which the platen roller 51 moves and a press releasing position 88 where the press roller 80 is located outside the path along which the platen roller 51 moves. The moving rod 85 is connected to the manual operation lever 84 and supports the press roller 80. The moving rod 85 is pulled up by a return spring 90 (see FIG. 5) so that the press roller 80 is located at the press releasing position 88. A roller shaft portion 91 is formed on the side face of the moving rod 85 to extend in the width direction of the sticky note H1 and rotatably support the press roller 80. In addition, above the roller shaft portion 91, a detection protrusion 92 that switching a detection sensor 27 is formed to extend perpendicularly to the roller shaft portion 91.

The manual operation lever 84 includes a lever body 94 and an operation button 95. The lever body 94 is connected to the distal end of the moving rod 85 and is formed to extend upward. The operation button 95 is provided on the upper end of the lever body 94. As a user presses down the operation button 95, the press roller 80 is moved from the press releasing position 88 to the pressing position 87 against the return spring 90.

The urging spring 64 contacts the roller drive shaft 59 of the platen roller 51 and urges the platen roller 51 toward the print position 49 using the bearing portion 61 of each roller arm 52 as a guide. Thus, as the pair of roller arms 52 pivot (move upward) to move the platen roller 51 from the pull up position 48 to the print position 49, the platen roller 51 slides to be moved to lower portion of the bearing portion 61 by the press roller 80 against the urging spring 64 and the position of the platen roller 51 is then restricted at the non-print position 50. On the other hand, as the pair of roller arms 52 pivot (move downward) to move the platen roller 51 toward the pull up position 48, the platen roller 51 is, owing to the urging force of the urging spring 64, slides to be moved to the upper portion of the bearing portion 61 to return to an original state. Namely, as the pair of roller arms 52 move the platen roller 51 to the print position 49 in a state where the press roller 80 is located at the press releasing position 88 (see FIG. 6A), the platen roller 51 is configured to be located at an appropriate print position 49.

Figure 4A:
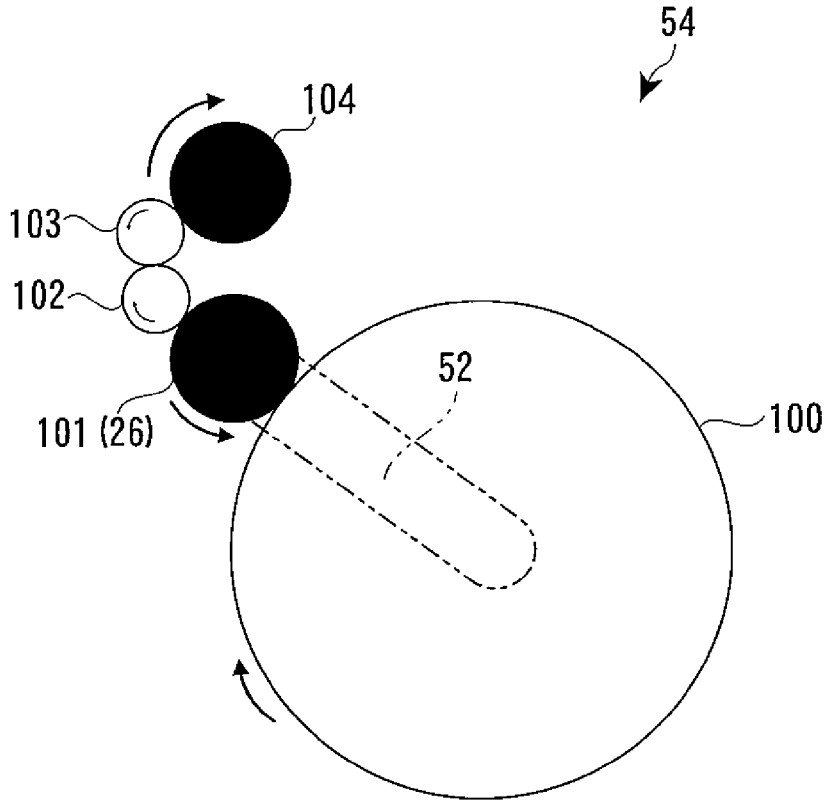
FIGS. 4A and 4B are schematic views, each illustrating a reduction gear train.
Figure 4B:
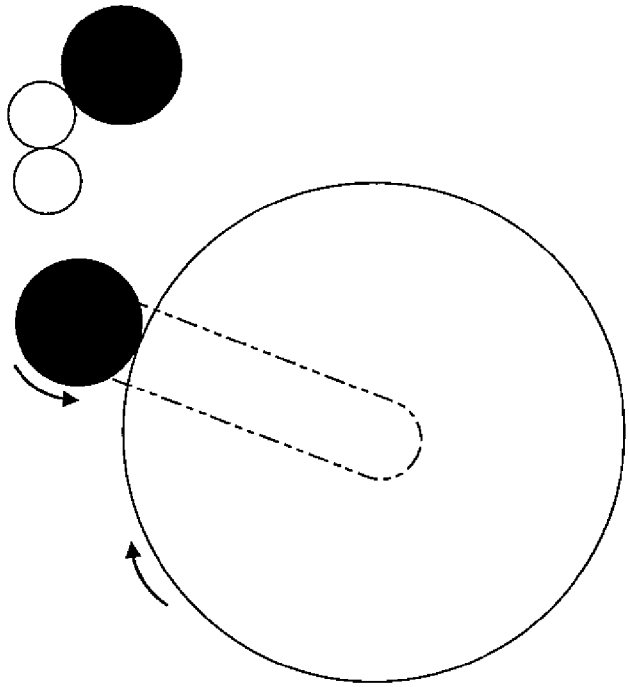

Here, the above reduction gear train will be described with reference to FIGS. 4A and 4B. The reduction gear train 54 transmits the power of the drive motor 53 to the platen roller 51, the pair of roller arms 52 and the ribbon take up shaft 75, and has planetary gears assembled therein where appropriate. The reduction gear train 54 includes a sun gear 100, a first planet gear 101, a first intermediate gear 102, a second intermediate gear 103 and a third intermediate gear 104. The sun gear 100 is formed to have the largest diameter and is rotated with the power of the drive motor 53. The first planet gear 101 is engaged with the sun gear 100. The first intermediate gear 102 is engaged with or disengaged from the first planet gear 101. The second intermediate gear 103 is engaged with the first intermediate gear 102. The third intermediate gear 104 is engaged with the second intermediate gear 103.

The shaft portion of the sun gear 100 is provided coaxially with the pivotal shaft portion 62 of the pair of roller arms 52. The first planet gear 101 outputs the power to the platen roller 51 provided coaxially therewith. In addition, the pair of roller arms 52 serve as a carrier of the first planet gear 101 and have an axis that is coaxial with that of the sun gear 100. That is, a position where the first planet gear 101 engages with the first intermediate gear 102 corresponds to the print position 49 where the platen roller 51 contacts the thermal head 70, and a position where the first planet gear 101 moves away from the first intermediate gear 102 and the roller arms 52 are oriented substantially horizontally corresponds to the pull up position 48. Thus, as the pair of roller arms 52 are pivoted between the pull up position 48 and the print position 49, the platen roller 51 is moved while being rotated. Note that the pivotal movement of the pair of roller arms 52 is performed by an end cam (not shown) which is driven by the drive motor 53 as a power source.

The power transmitted through the first planet gear 101 to the first intermediate gear 102 is transmitted through the second intermediate gear 103 to the third intermediate gear 104. The third intermediate gear 104 outputs the power to the ribbon take up shaft 75 provided coaxially therewith. That is, the ribbon take up shaft 75 is supplied with power input indirectly from the first intermediate gear 102. Note that, because the second intermediate gear 103 adjusts a rotational direction, the ribbon take up shaft 75 is not limited to the above configuration, it is applicable that the power is directly input from the first intermediate gear 102, that is, the ribbon take up shaft 75 is provided coaxially with the first intermediate gear 102.

As the drive motor 53 is rotated in a state where the platen roller 51 is located at the pull up position 48, the platen roller 51 is moved to the print position 49 by the roller arms 52 while it is being rotated. As the platen roller 51 is located at the print position 49, the first planet gear 101 is coupled to the first intermediate gear 102, and the power of the drive motor 53 is then transmitted through the second intermediate gear 103, the third intermediate gear 104 to the ribbon take up shaft 75.

On the other hand, in a state where the press roller 80 restricts the platen roller 51 being positioned at the non-print position 50, the first planet gear 101 is moved away from the first intermediate gear 102, so that the transmission of power to the ribbon take up shaft 75 is blocked. For this reason, as the platen roller 51 is moved away from the print position 49, the take up of the ink ribbon R by the ribbon feeding unit 24 is stopped. When the blank sticky note H1 is fed, there is no waste of ink ribbon R. In addition, because the drive motor 53 may be shared and there are many commonly used components, it is possible to simplify the structure. Accordingly, it is also possible to simplify the structure of the platen moving mechanism 25 and the structure around the ribbon feed stopping unit 26. Note that the ribbon feed stopping unit 26 corresponds to the first planet gear 101.

Figure 5:
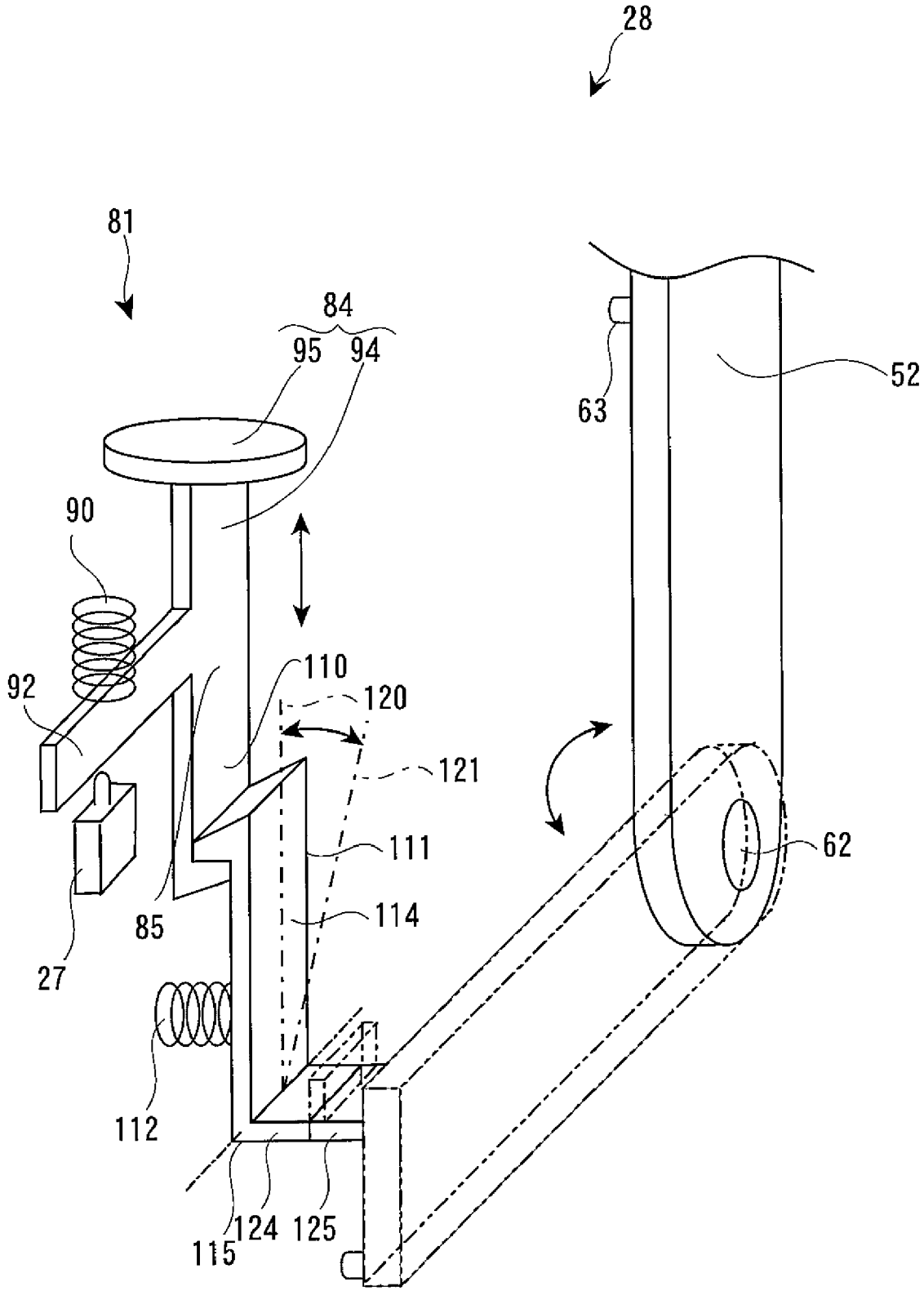
FIG. 5 is a schematic view of a locking/unlocking unit.

As shown in FIG. 5, the locking/unlocking unit 28 includes the releasing boss 63, a first engaging pawl 110, a second engaging pawl 111, an extension spring 112, and the return spring 90. The releasing boss 63 is provided on the side face of one of the pair of roller arms 52. The first engaging pawl 110 is formed to extend downward from the lower end of the moving rod 85. The second engaging pawl 111 is formed to have an L-shape in cross section and has an engaging portion 114 that engages with the first engaging pawl 110 and a contact piece 115 that contacts the releasing boss 63. The extension spring 112 pulls back the second engaging pawl 111 toward the moving rod 85.

The first engaging pawl 110 is configured to move in the top-and-bottom direction in response to operation of the manual operation lever 84. When the first engaging pawl 110 is positioned upward and disengaged from the second engaging pawl 111, the platen roller 51 is movable to the print position 49. When the first engaging pawl 110 is positioned downward to be engaged with the second engaging pawl 111, that is, when in a locked state, the press roller 80 restricts the platen roller 51 being positioned at the non-print position 50.

The second engaging pawl 111 has a bending portion that is pivotally supported and, hence, the second engaging pawl 111 is moved between a locked position 120 where the second engaging pawl 111 engages with the first engaging pawl 110 and a lock released position 121 where the second engaging pawl 111 is disengaged from the first engaging pawl 110. The engaging portion 114 engages with the first engaging pawl 110, and the engaging portion 114 is pulled by the extension spring 112 so that the engaging portion 114 is located at the locked position 120. The contact piece 115 has a fixed piece 124 that is connected to the engaging portion 114 and a movable piece 125 provided at the distal end side of the fixed piece 124. The movable piece 125 is provided so that the releasing boss 63 contacts the movable piece 125 by the pivotal movement of the roller arm 52. As the releasing boss 63 is moved from the print position 49 to the pull up position 48 with the roller arm 52, the movable piece 125 is pivoted downward about the bending portion together with the fixed piece 124 in order for the engaging portion 114 to be moved to the lock released position 121. On the other hand, as the releasing boss 63 is moved from the pull up position 48 to the print position 49, only the movable piece 125 is pivoted upward about a portion at which the movable piece 125 is connected to the fixed piece 124 so as to move the releasing boss 63 in order to maintain a state where the engaging portion 114 is located at the locked position 120.

When a user presses down the manual operation lever 84, the first engaging pawl 110 is moved downward against the return spring 90 and temporarily pushes away the second engaging pawl 111, located at the locked position 120, toward the lock released position 121 and then engages with the second engaging pawl 111, thus locking the press roller 80 at the pressing position 87. Thereafter, as the roller arms 52 move the platen roller 51 from the pull up position 48 toward the print position 49, the releasing boss 63 of the roller arm 52 is allowed to move by the movable piece 125, thus maintaining the locked state of the second engaging pawl 111. Then, as the roller arm 52 is returned from the print position 49 to the pull up position 48, the releasing boss 63 contacts the movable piece 125 and pulls down the second engaging pawl 111 to the lock released position 121. After that, the first engaging pawl 110 is pulled upward through the moving rod 85 by the return spring 90, the press roller 80 is moved to the press releasing position 88.

In this manner, the locking/unlocking unit 28 locks the press roller 80 at the pressing position 87 by manipulating the manual operation lever 84, so that it is possible to hold a state where the position of the platen roller 51 is restricted at the non-print position 50 through the press roller 80. Hence, when the sticky note H1 is being transported, a user need not to continue manipulating the manual operation lever 84. On the other hand, as the sticky note transport unit 22 completes transporting, the locked state is released in response to this completion. The press roller 80 is then moved to the press releasing position 88 by the return spring 90, so that a user need not to return the press roller 80 by manipulating the manual operation lever 84. For the above reasons, the manual operation lever 84 has a high operability.

The detection sensor 27 is provided below the detection protrusion 92 that extends from the moving rod 85 and is formed by a micro switch. As the moving rod 85 is moved downward using the manual operation lever 84 in order for the platen roller 51 to be located at the non-print position 50, the detection protrusion 92 contacts the distal end of the detection sensor 27, thus detecting the press roller 80 being moved to the pressing position 87. In addition, the personal computer 3, when it detects whether the press roller 80 is moved to the pressing position 87 by the detection sensor 27, does not drive the printing unit 23 but drives the sticky note transport unit 22 only. Hence, the sticky note H1 that has been peeled off by the sticky note transport unit 22 is not subject to printing but is transported. Accordingly, unless the press roller 80 is located at the pressing position 87, the blank sticky note H1 is not fed. Note that the detection sensor 27 is not limited to a micro switch, but it may be an optical sensor, such as a photo interrupter.

Here, a series of operations for feeding a blank sticky note H1 will be described with reference to FIGS. 6A to 6G. In a print stand-by state, the platen roller 51 is located at the pull up position 48 and rolls on and contacts the surface of the uppermost sticky note H1 of the sticky note bundle H that is set in the sticky note holder 20 (see FIG. 6A). On the other hand, the press roller 80 is located at the press releasing position 88 and is located at a distance away from the platen roller 51.

When a user presses down the manual operation lever 84 to move the press roller 80 to the pressing position 87, the detection protrusion 92 turns on the detection sensor 27, so that the personal computer 3 detects whether the press roller 80 is moved to the pressing position 87. Then, the personal computer 3, using the result detected by the detection sensor 27 as a trigger, initiates to pull up the sticky note H1 by rotating the platen roller 51. The rotated platen roller 51 rolls on and contacts the free end of the uppermost sticky note H1, so that the middle portion of the sticky note H1 in the longitudinal direction is bent so as to be gradually curved upward. In response to the pressing down of the manual operation lever 84, the locking/unlocking unit 28 locks the manual operation lever 84 and maintains a state where the press roller 80 is located at the pressing position 87 (see FIG. 6B).

Figures 6A, 6B, 6C, 6D, 6E, 6F, 6G:
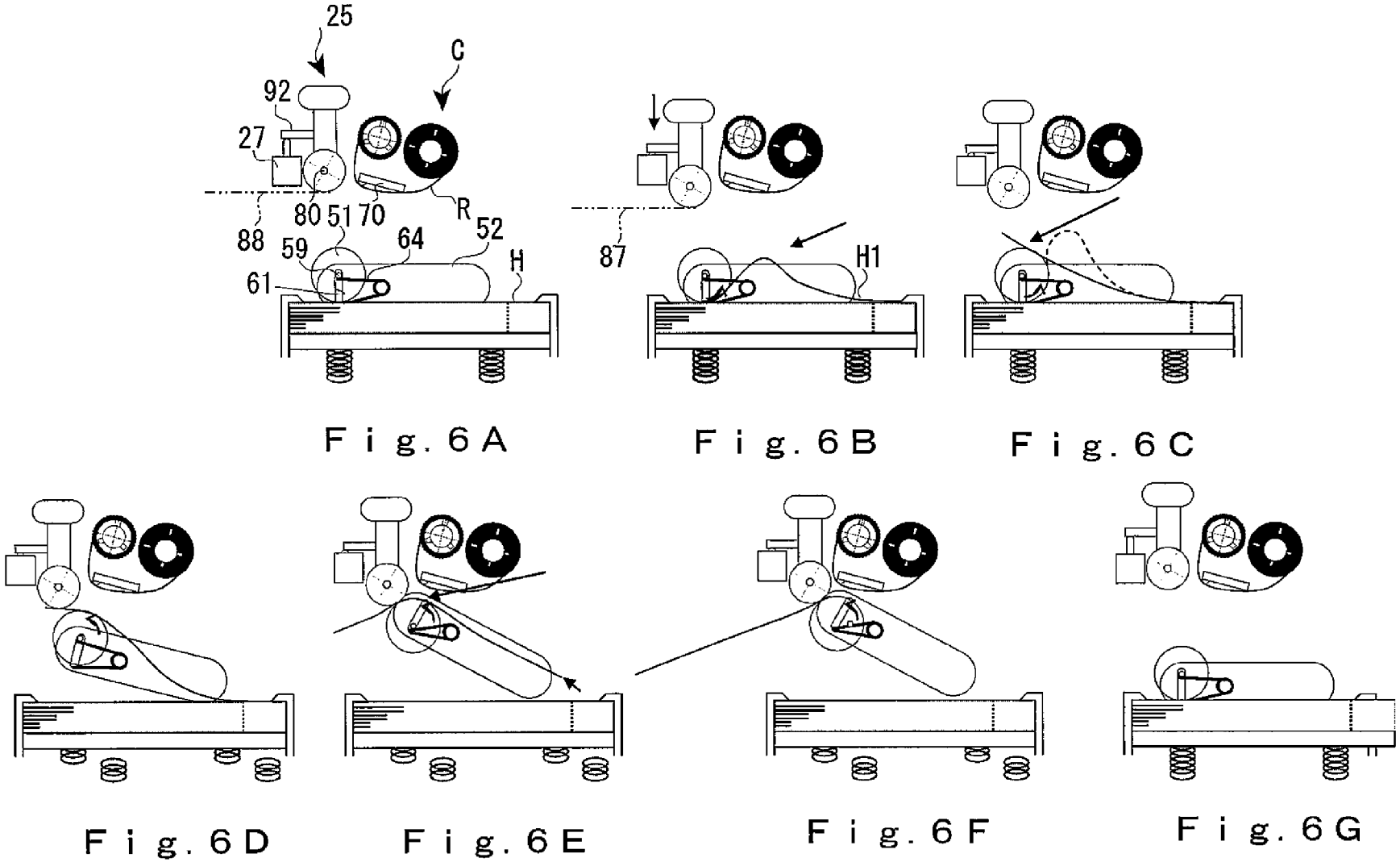
FIGS. 6A to 6G are views illustrating a series of operations for feeding a blank sticky note.

When the platen roller 51 is further rotated after the distal end of the sticky note H1, being pulled upward, passes below the platen roller 51, the sticky note H1 is turned by the platen roller 51 and the distal end portion of the sticky note H1 runs onto the platen roller 51 (see FIG. 6C).

The platen roller 51, on which the sticky note H1 is mounted, is subsequently moved (orbited) upward toward the print position 49 while being rotated (self-rotated) (see FIG. 6D). Then, the platen roller 51 contacts the press roller 80 that has moved to the pressing position 87, and the position of the platen roller 51 is then restricted at the non-print position 50. As the platen roller 51 reaches the non-print position 50 to pinch the sticky note H1 between the platen roller 51 and the press roller 80, the platen roller 51 peels off the pulled-up sticky note H1 from the sticky note bundle H and transports the sticky note H1 toward the sheet ejecting slot 16 (see FIG. 6E).

When the proximal end (adhesive portion) Hk of the sticky note H1 reaches the platen roller 51 (see FIG. 6F), the platen roller 51 is moved downward from the non-print position 50 toward the pull up position 48. Thus, the fed blank sticky note H1 is passed to the receiving portion 14 provided at the sheet ejecting portion 13, and the locking/unlocking unit 28 releases a locked state by means of the releasing boss 63 of the roller arm 52 and moves the press roller 80 to the press releasing position 88 (see FIG. 6G). Thereafter, a user takes away the sticky note H1 that has ejected to the sheet ejecting portion 13, so that it is possible to obtain the blank sticky note H1.

According to the above structure, by moving the platen roller 51 to the non-print position 50 when a blank sticky note is fed, it enters an opened state where the platen roller 51 is located a distance away from the thermal head 70, so that the sticky note H1 and the ink ribbon R are not pinched together between the thermal head 70 and the platen roller 51. In this manner, because the sticky note H1, while being fed, does not slide on the ink ribbon R, ink of the ink ribbon R does not stick on the sticky note H1 to smudge the sticky note H1 as it is rubbed by the sticky note H1, and the ink ribbon R is not fed with the sticky note H1 being fed. Furthermore, it is possible to appropriately transport the blank sticky note H1 toward the sheet ejecting slot 16 by the platen roller 51 and the press roller 80.

Note that the sticky note bundle H is used in the present embodiment; however, in place of the sticky note bundle H, it is possible to use a note bundle, or the like, whose fixed end surface is adhered. In addition, in the present embodiment, the platen roller 51 is moved toward the press roller 80, that has moved to the pressing position 87, by the roller arms 52, and the position of the platen roller 51 is thereby restricted at the non-print position 50. However, it is applicable that, after the platen roller 51 is moved to the print position 49, the platen roller 51 is pressed and moved to the non-print position 50 by the press roller 80.

Figure 7:
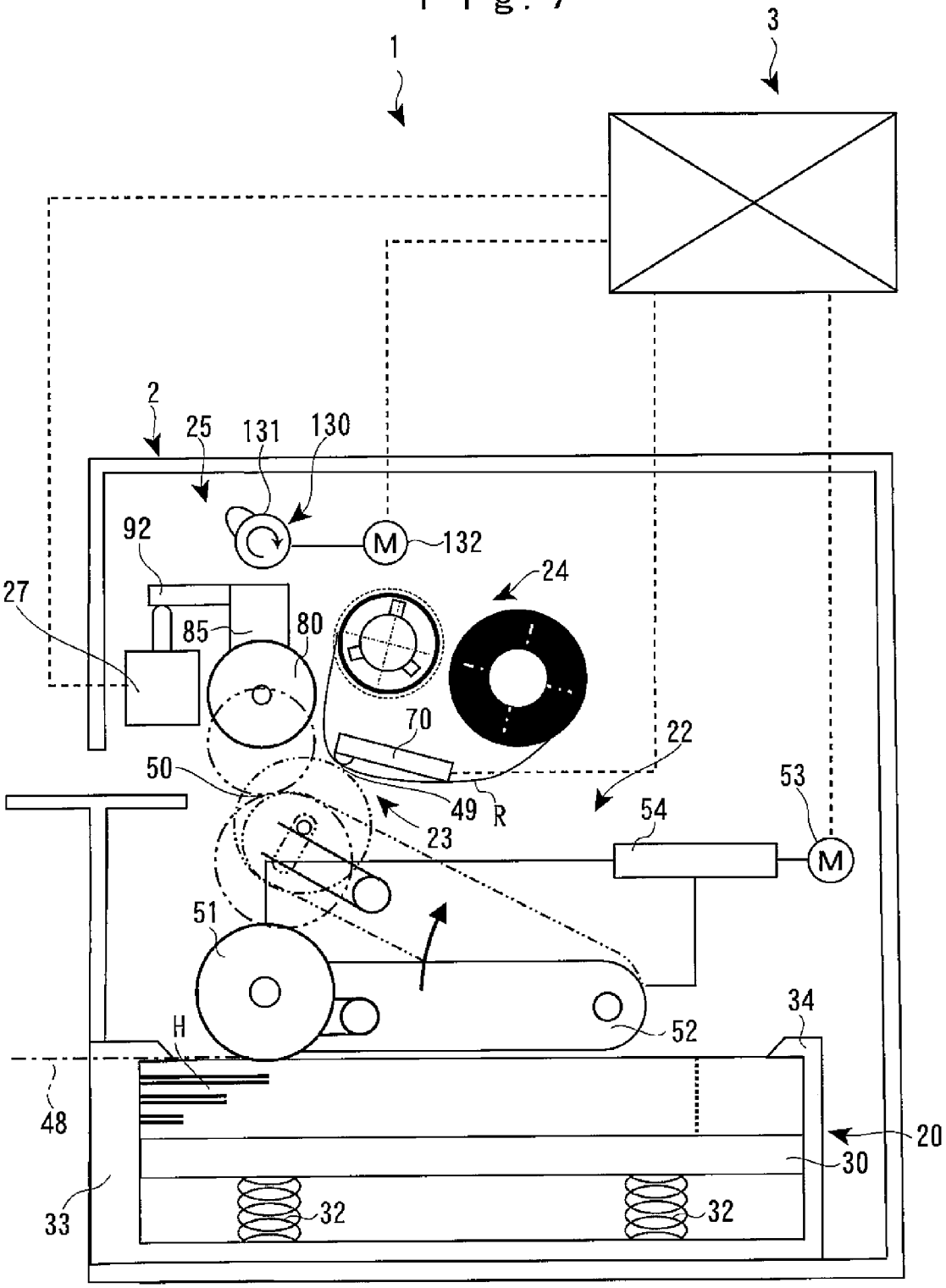
FIG. 7 is a schematic internal view of a sticky note printer according to a first alternative embodiment of the invention.

A first alternative embodiment of the sticky note printing system 1 will be described with reference to FIG. 7. The sticky note printing system 1 includes a first roller moving unit 130 in place of the manual operation unit 81 of the sticky note printer 2 according to the first embodiment. The sticky note printing system 1 specifically includes, in place of the manual operation lever 84, a plate cam 131 that presses the upper end face of the moving rod 85 downward and a motor 132 that rotates the plate cam 131. The motor 132 is controlled by the personal computer 3.

When the motor 132 is driven by the personal computer 3 in order to feed a blank sticky note H1, the plate cam 131 rotates and the protruding portion thereof presses the upper end face of the moving rod 85 downward to have the press roller 80 located at the pressing position 87, and the driving of the motor 132 is then stopped in that state. As the feeding of the blank sticky note H1 is completed, the motor 132 is driven again and the protruding portion of the plate cam 131 is moved upward, and the press roller 80 is then returned to the press releasing position 88 by the return spring 90. With this structure as well, it is possible to enter an opened state where, when the blank sticky note H1 is being fed, the platen roller 51 is located a distance away from the thermal head 70.

Figure 8:
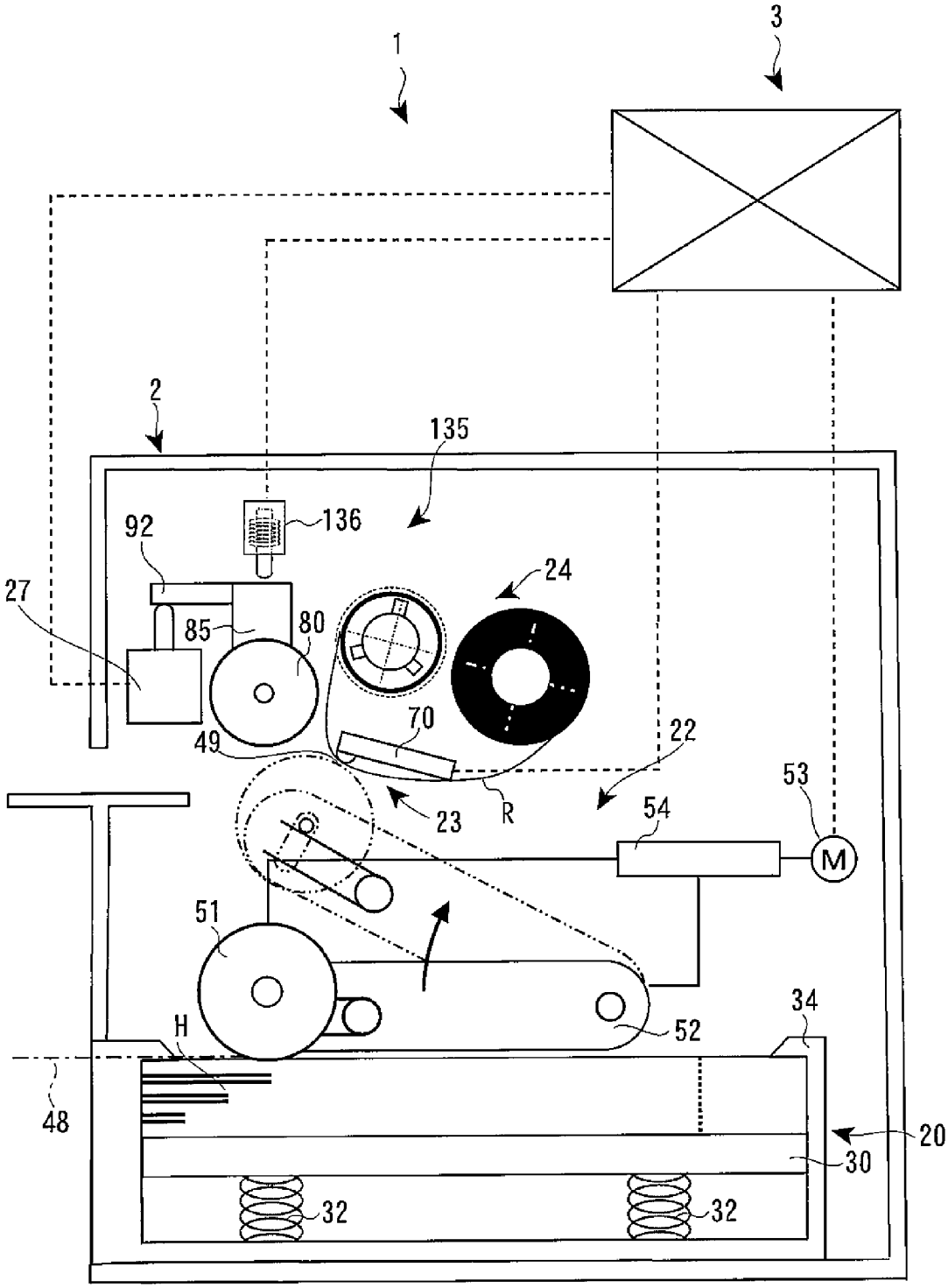
FIG. 8 is a schematic internal view of a sticky note printer according to a second alternative embodiment of the invention.

A second alternative embodiment of the sticky note printing system 1 will be described with reference to FIG. 8. The sticky note printing system 1 includes a second roller moving unit 135 in place of the manual operation unit 81 of the sticky note printer 2 according to the first embodiment. The sticky note printing system 1 specifically includes, in place of the manual operation lever 84, a solenoid 136 that presses the upper end face of the moving rod 85 downward, and the solenoid 136 is controlled by the personal computer 3.

As the solenoid 136 is energized by the personal computer 3 in order to feed a blank sticky note H1, the plunger of the solenoid 136 presses the upper end face of the moving rod 85 downward to have the press roller 80 located at the pressing position 87. As the feeding of the blank sticky note H1 is completed, the solenoid 136 is de-energized, and the press roller 80 is returned to the press releasing position 88 by the return spring 90. With this structure as well, it is possible to enter an opened state where, when the blank sticky note H1 is being fed, the platen roller 51 is located a distance away from the thermal head 70.

Figure 9:
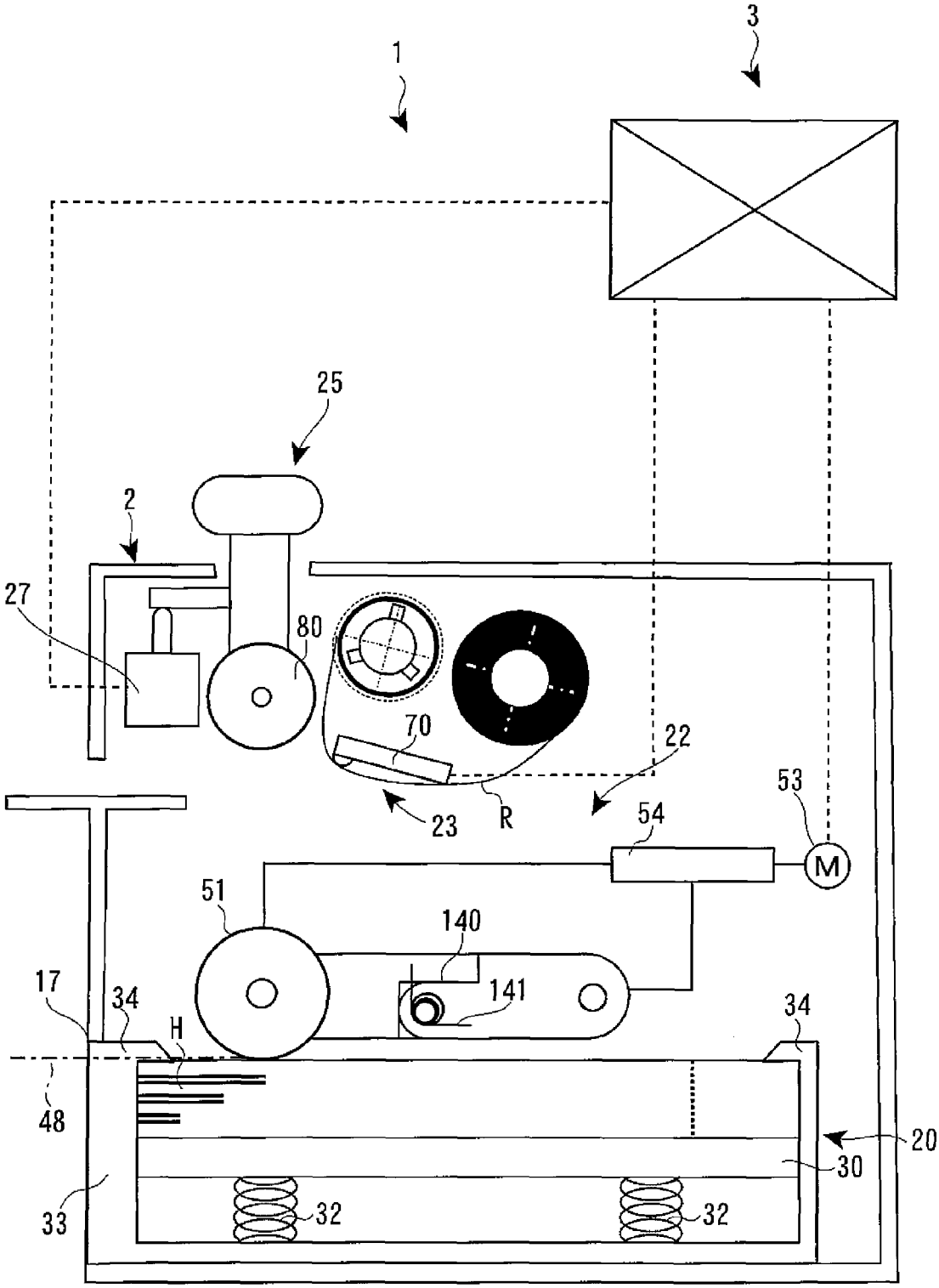
FIG. 9 is a schematic internal view of a sticky note printer according to a second embodiment of the invention.

A second embodiment of the sticky note printing system 1 will be described with reference to FIG. 9. Note that, for the purpose of avoiding duplicate description, the portions different from those of the first embodiment will be described only. The sticky note printing system 1 includes no urging spring 64 as in the case of the sticky note printer 2 of the first embodiment but includes the bearing portion 61 that is provided at the distal end portion of each roller arm 52 and that rotatably holds the platen roller 51. The middle portion of the arm body 60 of each roller arm 52 has a folded mechanism 140 that allows the distal end side of the arm body 60 to be bend toward the pull up position 48 and a reset spring (return spring) 141 that returns the bent arm body 60 to the original attitude.

The folded mechanism 140 is configured so that the roller arms 52 are bent only when the press roller 80 is located at the pressing position 87 and the platen roller 51 is moved from the pull up position 48 toward the print position 49. When the press roller 80 is located at the press releasing position 88, the roller arms 52 do not bend but move the platen roller 51 to the print position 49 appropriately.

As the press roller 80 is moved to the pressing position 87 and the platen roller 51 is moved toward the print position 49 by the roller arms 52 in order to feed the blank sticky note H1, the roller arms 52 bend using the folded mechanism 140 in a state where the position of the platen roller 51 is restricted at the non-print position 50 by the press roller 80. On the other hand, as the platen roller 51 is moved from the non-print position 50 to the pull up position 48 by the roller arms 52, the roller arms 52 return their bent attitude to the original attitude by the reset spring 141. With this structure as well, the reciprocal movements of the roller arms 52 are not changed, but it is still possible to restrict the position of the platen roller 51 at the non-print position 50 using the folded mechanism 140. Furthermore, it is possible to appropriately move the platen roller 51 to the print position 49 by the roller arms 52 by returning the bent attitude of the roller arms 52 to the original attitude by the reset springs 141.

A third embodiment of the sticky note printing system will be described without reference to any drawings. Note that, in this case as well, the portions different from those of the first embodiment will be described only. The sticky note printing system includes no urging spring 64 as in the case of the sticky note printer of the first embodiment but includes the bearing portion that is provided at the distal end portion of each roller arm and that rotatably holds the platen roller. A torque limiter is interposed between the pivotal shaft portions of the roller arms and the output shaft that outputs the power through the reduction gear train to the pivotal shaft portions.

As the press roller is moved to the pressing position and the platen roller is moved toward the print position by the roller arms in order to feed a blank sticky note, the rotations of the roller arms are slipped by the torque limiter at the time when the position of the platen roller is restricted at the non-print position by the press roller. Therefore, it is possible to hold a state where the position of the platen roller is restricted at the non-print position. On the other hand, in a state where the pressing is released by the press roller, the roller arms may appropriately move the platen roller to the print position.

What is claimed is:

1. A sheet bundle printer that peels off an uppermost sheet out of a sheet bundle that is formed by stacking a multiplicity of sheets, each having one end that is peelably adhered to that of another sheet, and that performs printing on the sheet while transporting the sheet toward a sheet ejecting slot, comprising:

a print head that performs printing on the sheet;

a platen roller that, when located at a print position where the platen roller contacts the print head, cooperates with the print head to feed both the sheet and an ink ribbon, which are pinched between the print head and the platen roller; and a platen moving mechanism that moves the platen roller between the print position and a non-print position where the sheet is passed toward the sheet ejecting slot in a state where the sheet is located away from the print head, wherein the platen moving mechanism includes:

a manual operation device used for manually moving the platen roller from the print position to the non-print position; and a press roller that is made to contact or move away from the platen roller by means of the manual operation device and that moves the platen roller from the print position to the non-print position while pressing the platen roller in a state where the press roller is in contact with the platen roller, and wherein at the non-print position, the sheet is allowed to pass between the press roller and the platen roller.

2. The sheet bundle printer according to claim 1, wherein the manual operation device includes:

a manual operation lever that is manipulated for moving the press roller; and a moving rod that moves the press roller by manipulating the manual operation lever.

3. The sheet bundle printer according to claim 2, further comprising:

a reset device that resets the platen roller that has moved to the non-print position, to the print position in response to releasing of the press roller pressing the platen roller; and a locking/unlocking device that includes:

a locking device that holds a state where the platen roller is moved to the non-print position by manipulating the manual operation lever through the press roller; and a lock releasing device that, after transporting of the sheet by the press roller and the platen roller is completed, moves the platen roller, using the reset device, to the print position.

4. The sheet bundle printer according to claim 1, further comprising:

a detection device that detects whether the platen roller is moved to the non-print position by the press roller; and a control device that controls the print head, the platen roller and the platen moving mechanism, wherein the control device controls feeding of the sheet toward the sheet ejecting slot on the basis of a result detected by the detection device.

5. The sheet bundle printer according to claim 1, further comprising:

a reset device that resets the platen roller that has moved to the non-print position, to the print position by releasing the press roller pressing the platen roller; and a bearing portion that pivotally supports the platen roller so as to slide between the print position and the non-print position, wherein the reset device has an urging member that is in contact with a rotary shaft portion of the platen roller and that urges the platen roller toward the print position while the platen roller is being guided by the bearing portion.

6. The sheet bundle printer according to claim 1, wherein the platen roller doubles as a roller for pulling up and peeling off the sheet, wherein the sheet bundle printer further comprises:

a roller arm that holds the platen roller at its distal end and that allows the platen roller to reciprocally move between a pull up position where the sheet is pulled up and the print position, having the non-print position located in a path of the reciprocal movement;

a folded mechanism that is provided in the roller arm and that holds the roller arm to be foldable only when the platen roller is moved from the pull up position toward the print position; and a return spring that returns the roller arm, when being folded, to an original attitude, and wherein the return spring doubles as the reset device.

7. The sheet bundle printer according to claim 1, wherein the platen roller doubles as a roller for pulling up and peeling off the sheet, wherein the sheet bundle printer further comprises:

a roller arm that holds the platen roller at its distal end;

a shaft portion that is provided at the proximal end of the roller arm and that supports the roller arm;

a pivotal device that pivots the roller arm through the shaft portion so as to move the platen roller between a pull up position where the sheet is pulled up and the print position, having the non-print position located in a path of the reciprocal movement; and a torque limiter provided between the shaft portion and the pivotal device, and wherein the pivotal device doubles as the reset device.

8. The sheet bundle printer according to claim 1, further comprising:

a ribbon feed device that feeds the ink ribbon side by side with the sheet when the sheet is printed; and a ribbon feed stopping device that stops the ribbon feed device feeding the ink ribbon in response to movement of the platen roller to the non-print position by the platen moving mechanism.

9. A sheet bundle printing system comprising:

the sheet bundle printer according to claim 1, wherein the sheet bundle printer includes a detection device that detects whether the platen roller is moved to the non-print position by the press roller; and a computer that is connected to the sheet bundle printer and that controls the sheet bundle printer, wherein the computer includes a control device that controls the print head, the platen roller and the platen moving mechanism, and wherein the control device controls feeding of the sheet toward the sheet ejecting slot without performing printing on the sheet on the basis of a result detected by the detection device.

10. A sheet bundle printer that peels off an uppermost sheet out of a sheet bundle that is formed by stacking a multiplicity of sheets, each having one end that is peelably adhered to that of another sheet, and that performs printing on the sheet while transporting the sheet toward a sheet ejecting slot, comprising:

a print head that performs printing on the sheet;

a platen roller that, when located at a print position where the platen roller contacts the print head, cooperates with the print head to feed both the sheet and an ink ribbon, which are pinched between the print head and the platen roller; and a platen moving mechanism that moves the platen roller between the print position and a non-print position where the sheet is passed toward the sheet ejecting slot in a state where the sheet is located away from the print head, wherein the platen moving mechanism includes:

a roller moving device used for moving the platen roller from the print position to the non-print position; and a press roller that is made to contact or move away from the platen roller by means of the roller moving device and that moves the platen roller from the print position to the non-print position while pressing the platen roller in a state where the press roller is in contact with the platen roller, and wherein at the non-print position, the sheet is allowed to pass between the press roller and the platen roller.

11. The sheet bundle printer according to claim 10, wherein the roller moving device includes:

a solenoid used for moving the press roller; and a moving rod that moves the press roller by driving of the solenoid.

12. The sheet bundle printer according to claim 10, wherein the roller moving device includes:

an actuator used for moving the press roller;

a plate cam that is made to rotate by driving of the actuator; and a moving rod that moves the press roller on the basis of a state where the plate cam contacts the moving rod.

* * * * *